United States Patent [19]

Aoyama

[11] 4,186,699

[45] Feb. 5, 1980

[54] EXHAUST GAS RECIRCULATION SYSTEM

[75] Inventor: Syunichi Aoyama, Yokohama, Japan

[73] Assignee: Nissan Motor Company, Limited, Yokohama, Japan

[21] Appl. No.: 875,819

[22] Filed: Feb. 7, 1978

[30] Foreign Application Priority Data

| | | | |
|---|---|---|---|
| Mar. 27, 1973 | [AU] | Australia | 53800/73 |
| Oct. 17, 1974 | [DE] | Fed. Rep. of Germany | 2449431 |
| May 15, 1975 | [DE] | Fed. Rep. of Germany | 2521681 |
| Feb. 8, 1977 | [JP] | Japan | 52-12048 |
| Aug. 12, 1977 | [JP] | Japan | 52-96121 |

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 4,013,052 | 3/1977 | Masaki et al. | 123/119 A |
| 4,031,871 | 6/1977 | Hamanishi | 123/119 A |
| 4,041,917 | 8/1977 | Suzuki | 123/119 A |
| 4,109,624 | 8/1978 | Washio et al. | 123/119 A |
| 4,122,808 | 10/1978 | Vogelsberg | 123/119 A |
| 4,124,004 | 11/1978 | Aoyama | 123/119 A |
| 4,128,090 | 12/1978 | Aoyama | 123/119 A |
| 4,142,496 | 3/1979 | Saito et al. | 123/119 A |

*Primary Examiner*—Wendell E. Burns

[57] ABSTRACT

An exhaust gas recirculation system comprises a valve assembly for controlling the recirculation of exhaust gases in such a manner as to maintain a difference between a first and second pressure at a predetermined value. The first pressure is a pressure in a zone in an air induction passage between a throttle valve therein and a flow restrictor disposed therein downstream of the throttle valve, while the second pressure is a pressure in a zone in an exhaust gas recirculation passage between an exhaust gas recirculation flow control valve member and a second flow restrictor disposed therein downstream of the valve member.

11 Claims, 6 Drawing Figures

EXHAUST GAS RECIRCULATION SYSTEM

BACKGROUND OF THE INVENTION

This invention relates to exhaust gas recirculation systen in internal combustion engines and more particularly to a valve assembly for controlling exhaust gas recirculation.

Recirculation of exhaust gases has been developed as a method for reducing formation of oxides of nitrogen (NOx) during the combustion process in an internal combustion engine. In general, it is desired to control exhaust gas recirculation in response to engine operating conditions, and a variety of control valves responsive to the engine operating conditions have been utilized for this purpose.

A valve responsive to exhaust gas pressure so as to recirculate the exhaust gases at a rate proportional to the rate at which combustion air (induction air) flows into the engine has been proposed by the same inventor as that of this application. This will be more particularly described hereinafter.

The exhaust gas recirculation control valve assembly which has been proposed by the same inventor utilizes a difference between a first pressure within an exhaust passage in a zone downstream of a first orifice provided in the exhaust passage downstream of an inlet port of an exhaust gas recirculation passage and a second pressure within the exhaust gas recirculation passage in a zone between a second orifice provided in the exhaust gas recirculation passage and an exhaust gas flow control valve member disposed in the exhaust gas recirculation passage downstream of the second orifice, so as to recirculate exhaust gases at a rate proportional to exhaust gas flow through the exhaust passage in order to recirculate exhaust gases at a rate proportional to air flow toward an engine. The valve is operated to keep this difference at a predetermined magnitude. The rate of recirculation of exhaust gases is thus proportional to the rate of exhaust gas flow through the exhaust passage. Since the rate of exhaust gas flow is proportional to the rate of induction air flow, exhaust gases can be recirculated at a rate proportional to induction air flow.

With this exhaust gas recirculation control valve assembly the exhaust gas flow control valve member is not directly operated by the member responsive to the difference between the first and second pressure; instead, the valve member is positioned by a member operated by an induction passage vacuum signal and the member responsive to the difference between the first and second pressure controls that signal.

In order to reduce the rate of recirculation of exhaust gases under engine operating condition at high speed with light load so as to maintain the engine stability under this condition, the member responsive to the difference between the first and second pressure is biased in such a manner as to assist movement of the member due to the first pressure by a member which is alternatively responsive to the control signal or atmosphere through a control valve.

Although with this exhaust gas recirculation control valve assembly the rate of recirculation of exhaust gases is proportional to the rate of exhaust gas flow through the exhaust gas passage there is a problem that the proportional relationship between the rate of recirculation of exhaust gas through the exhaust gas passage and the rate of induction air flow may be disturbed or broken such as when there occurs the pulsation of exhaust gases. Another problem is that the first orifice provided in the exhaust gas passage so as to reduce the effect of the pulsation of exhaust gases on the proportional relationship (the smaller is the effective flow area of the orifice provided in the exhaust passage, the better the precision of the proportional relationship between the rate of recirculation of exhaust gases and the rate of induction air) will cause a reduction in the maximum output of the engine by throttling exhaust gas flow through the exhaust gas passage. Still another problem is in that suitable measure must be taken to reduce the effect of the dirty deposit and the heat of the exhaust gases upon the component parts of the recirculation control valve assembly.

SUMMARY OF THE INVENTION

In order to solve the above mentioned problems an exhaust gas recirculation control valve assembly in an exhaust gas recirculation system according to the invention utilizes a difference between a pressure within an induction passage in a zone between a first orifice provided in the induction passage upstream of a discharge port of an exhaust gas recirculation passage and a throttle valve disposed upstream of the first orifice and a pressure within the exhaust gas recirculation passage in a zone between a second orifice provided in the exhaust gas recirculation passage and an exhaust gas recirculation flow control valve member disposed upstream of the second orifice to recirculate exhaust gases. The exhaust gas recirculation flow control valve member is operated to maintain this difference at a predetermined magnitude which may be varied in response to operating conditions of the associated engine so as to vary the rate of recirculation of exhaust gases.

DESCRIPTION OF THE PREFERRED EMBODIMENTS

Figure 1:
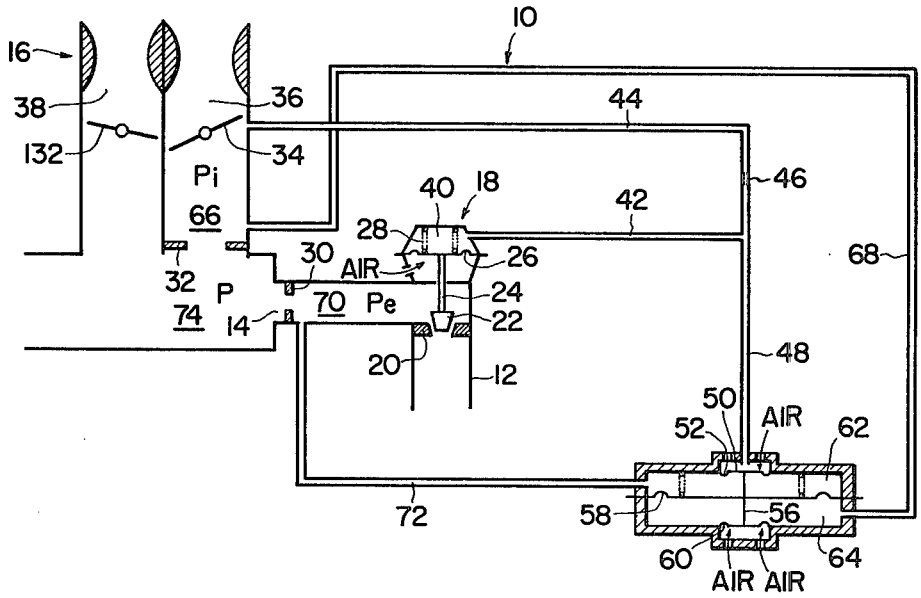
FIG. 1 is a schematic diagram showing a preferred embodiment of an exhaust gas recirculation system according to the invention.

FIG. 1 shows an embodiment 10 of an exhaust gas recirculation system comprising an exhaust gas recirculation (EGR) passage 12 leading from an exhaust passage (not shown) to a discharge port 14 opening to an air induction passage 16 and an exhaust gas flow control valve assembly 18 comprising a valve seat 20 located in EGR passage 12 and an exhaust gas flow control valve member or EGR valve member 22 cooperating with valve seat 20. EGR valve member 22 is formed on a stem 24 which is fixedly carried by a pressure responsive diaphragm 26 and is downwardly biased by a spring 28.

A flow restrictor in the form of an orifice plate 30 is arranged in EGR passage 12 downstream of valve seat 20, and a second flow restrictor in the form of a second orifice plate 32 is arranged in air induction passage 16 upstream of discharge port 14. Second orifice plate 32 is located downstream of a throttle valve 34 in a primary air induction barrel 36 of a two-barrel carburetor having a secondary air induction barrel 38.

A chamber 40 above diaphragm 26 is connected through pipes 42 and 44 to a source of vacuum such as that in primary air induction barrel 36 below throttle valve 34 or that in air induction passage 16 at a location adjacent discharge port 14. Arranged in pipes 42 and 44 between chamber 40 and the source of vacuum is an orifice 46. An air bleed pipe 48 is branched from a portion of pipes 42 and 44 between chamber 40 and orifice 46.

An air bleed through air bleed pipe 48 into chamber 40 is controlled by an air bleed control valve member 50. Air bleed control valve member 50 is formed on a diaphragm 52 or fixedly carried thereby and is downwardly biased by a spring 54, and is fixedly connected by a stem 56 to a pressure responsive diaphragm 52 and diaphragms 58 and 60.

Diaphragms 52 and 60 have substantially the same working areas respectively exposed to a chamber 62 above pressure responsive diaphragm and a chamber below it so as to permit stem 56 to be moved in response to the difference between pressures in chambers 62 and 64.

A pressure Pi in a zone 66 between orifice plate 32 and throttle valve 34 is transmitted through a pipe 68 to chamber 64 below diaphragm 58, while a pressure Pe in a zone 70 between valve seat 20 and orifice plate 30 is transmitted through a pipe 72 to chamber 62 above diaphragm 58.

In operation, an increase in difference, in magnitude, between pressure Pi in zone 66 and pressure Pe in zone 70 above a predetermined value will cause diaphragm 58 to be raised against the bias of spring 54 and air bleed valve member 50 thus reduces air flow through air bleed pipe 48 into chamber 40. As pressure in chamber 40 decreases, diaphragm 26 is raised against the bias of spring 28 and EGR valve member 22 is unseated from valve seat 20 so as to permit increased recirculation of exhaust gases. As a result pressure Pe in zone 70 increases. Upon a decrease in difference, in magnitude, between pressure Pi in zone 66 and pressure Pe in zone 70 below the predetermined value spring 54 depresses diaphragm 58 and air bleed valve member 50 then permits increased air flow through air bleed pipe 48 to chamber 40. The increased pressure in chamber 40 causes spring 28 to depress diaphragm 26 so as to moved EGR valve member 22 toward valve seat 20 and thus reduce the recirculation of exhaust gases. As a result pressure Pe in zone 70 decreases.

It will be noted that if, as in the embodiment shown in FIG. 1, EGR control valve member 22 recirculates exhaust gases in such a manner as to maintain difference, in magnitude, between pressure Pi in zone 66 and pressure Pe in zone 70 at the predetermined value, the rate of recirculation of exhaust gases will be proportional to the rate of induction air flow because the rate of induction air flow is the function of difference between pressure Pi in zone 66 and pressure P in a zone 74 downstream of orifice plate 32 and the rate of recirculation of exhaust gases is the function of difference between pressure Pe in zone 70 and pressure P in zone 74.

Assuming pressure Pi in zone 66 is fixed, a change in exhaust back pressure causes a change in pressure Pe in zone 70. Upon this change in pressure Pe in zone 70, air bleed valve member 50 controls air bleed through air bleed pipe 48 to chamber 40 and EGR valve member 22 thus controls the recirculation of exhaust gases so as to permit pressure Pe in zone 70 to restore its preceding magnitude i.e., the magnitude in pressure Pe before the change in exhaust back pressure takes place. Thus the effect of the change in exhaust back pressure which might take place irrespective of change in induction air flow on recirculation of exhaust gases is reduced in the embodiment shown in FIG. 1.

It is desirable, for the purpose of giving a good proportional dependency of pressure Pi on the rate of induction air flow through zone 66, to select, as orifice plate 32, one having a small orifice size because the smaller, in orifice size, the better.

The arrangement of orifice plate 32, i.e., orifice plate 32 is provided not in secondary air induction barrel 38 but in primary air induction barrel 36, has made it possible to secure an effective flow area wide enough to admit induction air at such a rate as to meet the demand under engine operating condition at full load. Thus, a reduction in the maximum power output resulting from the provision of orifice plate 32 is negligible.

If desired the predetermined value may be varied in response to a parameter or parameters representing engine operating condition so as to add a supplementary control on the recirculation of exhaust gases. It is thus possible to effectively reduce the rate of recirculation of exhaust gases under engine operation condition at high speed with light load by varying the predetermined value so as to cause EGR valve member 22 to reduce recirculation of exhaust gases under this engine operating condition.

If desired diaphragm 52 may be replaced with a diaphragm having a wide effective working area than diaphragm 60 so as to supplementary bias air bleed valve member 50 in such a manner as to assist the bias of spring 54 with a force which increases as pressure Pe in zone 70 decreases. As a result the predetermined value increases when the engine operates at a high speed with light load when pressure Pe is low and the recirculation of exhaust gases is effectively reduced under this engine operating condition.

Figure 2:
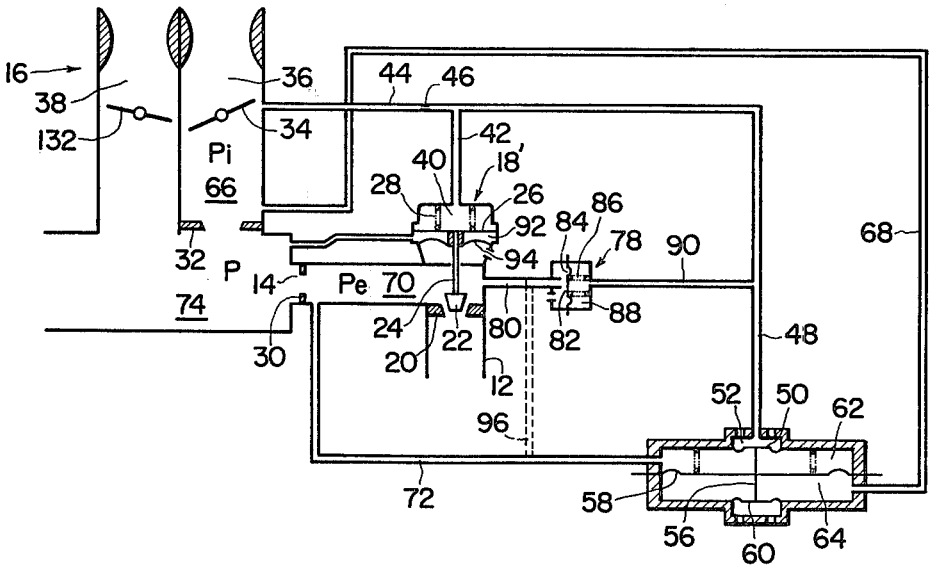
FIGS. 2 through 6 are similar views showing different preferred embodiments, respectively.

If desired, as shown in FIG. 2, an air bleed valve 78 is arranged so as to allow, when the engine operates at high speed with light load, air bleed into chamber 62 to cause an increase in pressure Pe therein to supplementarily bias air bleed valve member 50 in such a manner as to assist the bias of spring 54 so that the rate of recirculation of exhaust gases will be effectively reduced under this engine operating condition.

Referring to FIG. 2 the same reference numerals as those used in FIG. 1 are used to denote substantially similar parts to those shown in FIG. 1.

In FIG. 2 an air bleed pipe 80 leads from zone 70 of EGR passage 12 to air bleed valve 78 having a valve member 82 which is fixed to a diaphragm 84 and biased by a spring 86. A chamber 88 on the right hand side of diaphragm 84 communicates through a branch pipe 90, pipe 48 and pipe 42 with chamber 40 above diaphragm 26. An exhaust gas flow control valve assembly 18' in FIG. 2 differs from the counterpart shown in FIG. 1 in that in FIG. 2 EGR valve member 22 which is biased downwardly by spring 28 is biased in the same direction with a supplementary force which varies in response to a pressure transmitted from a source of vacuum such as that in air induction passage 16 at a location adjacent discharge port 14 or that in primary air induction barrel 36 below throttle valve 34 to a biasing chamber 92 below diaphragm 26 and above a diaphragm 94. Diaphragm 94 has its central portion fixedly connected to stem 24 and has a smaller working area than diaphragm 26 so that EGR valve 22 will be biased with a total of a force by spring 28 and supplementary force varying in response to pressure in biasing chamber 92.

In operation pressure within biasing chamber 92 is far lower when the engine operates at high speed with light load than when the engine operates with heavy loads and it is when the engine operates at high speed with light load that pressure within chamber 40 decreases to such a degree as to urge valve member 82 against the bias of spring 86 to increase air flow through air bleed pipe 80 into zone 70. As a result pressure Pe within zone 70 increases and the thus increased pressure is transmitted to chamber 62 to increase air flow through air bleed passage 48 to chamber 40 to cause an increase in pressure in chamber 40 permitting EGR valve member 22 to move toward valve seat 22 to reduce the recirculation of exhaust gases. It is to be noted that as air bleed through 80 to zone 70 increases fresh air fuel mixture flowing through air induction passage 16 will be diluted. Thus it will be appreciated that since when the engine operates at high speed with light load EGR valve member 22 will be moved toward valve seat 20 to effectively reduce the rate recirculation of exhaust gases owing to the help of admission of air, through air bleed valve 78 and air bleed pipe 80, to zone 70 and the thus admitted air will dilute fresh air fuel mixture through air induction passage 16, the engine stability and fuel economy under this engine operating condition will be improved.

If desired air bleed valve 78 may communicates through a branch pipe 96 directly with chamber 62 bypassing zone 70 to permit air bleed through pipe 90 to chamber 62. In this case, dilution of fresh air fuel mixture with air during engine operating condition at high speed with light load will not take place.

Figure 3:
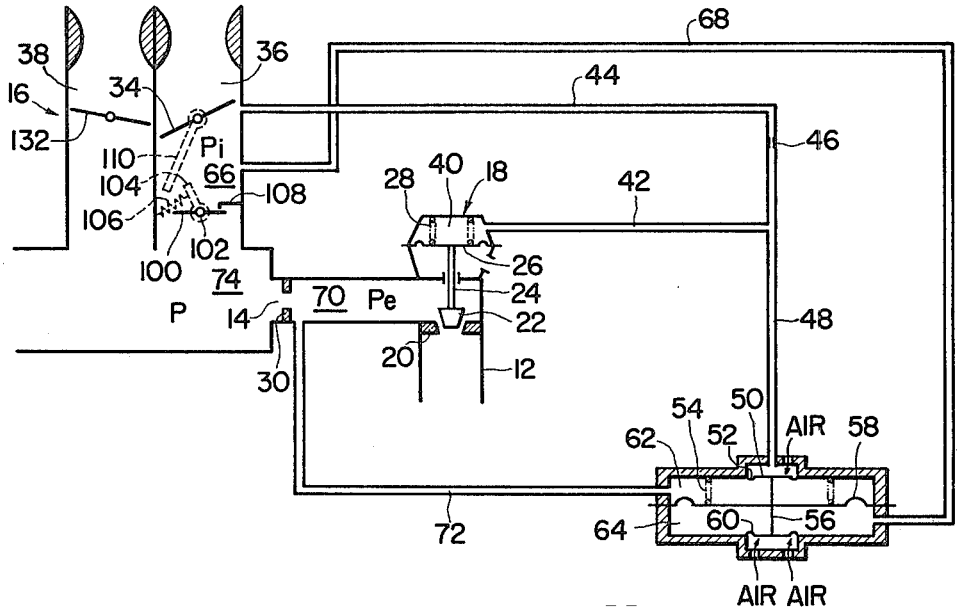

Referring to FIG. 3 the same reference numerals as those used in FIG. 1 are used to denote similar parts to those shown in FIG. 1. This embodiment shown in FIG. 3 is different from FIG. 1 embodiment only in that instead of orifice plate 32 shown in FIG. 1 a valve member 100 is disposed in primary air induction barrel 36 downstream of throttle valve 34 as shown in FIG. 3. Valve member 100 is rotatable with a shaft 102 fixed to a lever 104 disposed outside primary air induction barrel 36 and biased by a spring 106 toward the illustrated position. This illustrated position of valve member 100 is defined by a stop 108. A lever 110 fixedly attached to throttle valve 34 to be rotatable therewith cooperates with lever 104 such that opening movement of throttle valve 34 beyond a predetermined throttle opening degree, say, about 20 degrees, will cause lever 110 to coacts with lever 104 to rotate valve member 100 clockwise against the bias of spring 106. The effective flow area across valve member 100 thus will be increased as throttle valve 34 increases its throttle opening degree beyond the predetermined throttle opening degree.

As valve member 100 is rotated clockwise to increase effective flow area, the flow resistance through primary air induction barrel 36 decreases causing pressure Pi in zone 66 to decrease toward induction pressure P. Upon a decrease in pressure Pi, air bleed valve 50 is biased downwardly to increase air bleed through air bleed pipe 48 to chamber 40. As a result EGR valve member 22 is moved toward valve seat 20 to reduce the recirculation of exhaust gases.

Thus under engine operating condition with heavy load when the throttle opening degree of throttle valve 34 is above the predetermined degree (for example 20 degrees) the rate of recirculation of exhaust gases decreases and the driveability and fuel economy are improved under this engine operating condition.

Figure 4:
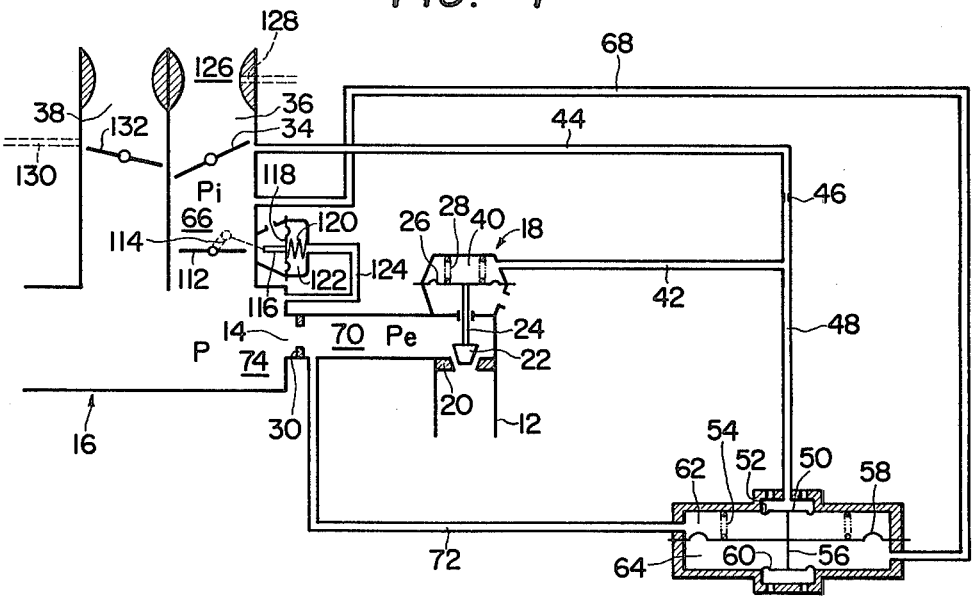

Referring to FIG. 4, a valve member 112 which is disposed in primary air induction barrel 36 downstream of throttle valve 34 and upstream of discharge port 14 is employed instead of orifice plate 32 shown in FIG. 1. Valve member 112 is operatively connected through a linkage 114 to a plunger 116 which is fixedly connected to a pressure responsive diaphragm 118 and biased by a spring 120. A chamber 122 on the righthand side of pressure responsive diaphragm 118 communicates with zone 74 of air induction passage 16 through a pipe 124 so as to allow induction pressure P in zone 74 to be transmitted to chamber 122.

In operation, when induction pressure P decreases below a predetermined value, such as −300 mmHg, under engine operating condition with light load, plunger 116 is moved to the right against the bias of spring 120 to cause valve member 112 to increase the effective flow area through primary air induction barrel 36. Thus the rate of recirculation of exhaust gases is reduced under engine operating condition when induction pressure decreases below the predetermined value, such as −300 mmHg.

If desired chamber 122 may communicate with a venturi 126 upstream of throttle valve 34 through a port 128 to allow venturi pressure in venturi 126 to be transmitted to chamber 122. In operation, when venturi pressure in venturi 126 decreases below a predetermined value, such as −200 mmAq, upon engine operating condition at high speed with heavy load, plunger 116 is moved to the right against the bias of spring 120 to cause valve member 112 to increase the effective flow area through primary air induction barrel 36. Thus the rate of recirculation of exhaust gases is reduced under engine operating condition at high speed with heavy load.

If desired chamber 122 may communicate with secondary air induction barrel 38 through a port 130 disposed above a throttle valve 132 disposed in secondary air induction barrel 38. In operation, when pressure within secondary air induction barrel 38 adjacent port 130 decreases below a predetermined value, such as −20 mmHg, under engine operating condition at high speed with heavy load, plunger 116 is moved to the right against the bias of spring 120 to cause valve member 112 to increase the effective flow area through primary air induction barrel 36. Thus the rate of recirculation of exhaust gases is reduced under the engine operating condition at high speed with heavy load.

Figure 5:
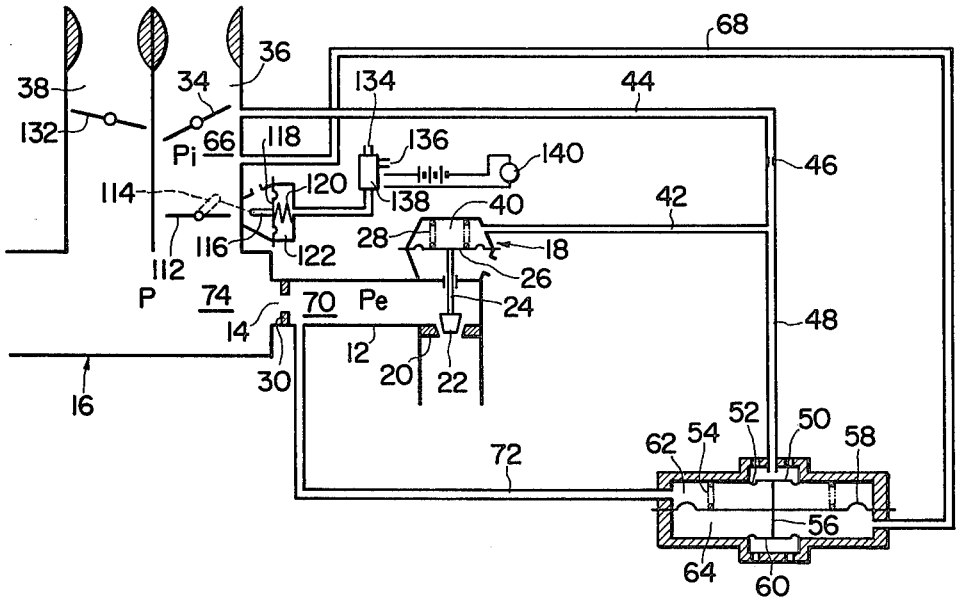

If desired, as shown in FIG. 5, chamber 122 may be connected to an air bleed port 134 and to a vacuum port 136 that communicates with a source of vacuum such as that in zone 74 in induction passage 16. A solenoid valve 138 which selectively closes air bleed port 134 or vacuum port 136 is provided and electrically circuited with a switch 140 responsive to engine operating condition or vehicle operating condition such as a vehicle speed switch.

In operation when the vehicle speed is above a predetermined value, such as 50 km/h, switch 140 is closed to permit a current to flow through the solenoid of solenoid valve 138 to cause solenoid valve to close air bleed port 134 so as to connect chamber 122 to the source of vacuum. As a result plunger 116 is moved to the right against the bias of spring 120 to cause valve member 112 to increase the effective flow area through primary air induction barrel 36 under this condition. When the vehicle speed is below the predetermined value, switch 140 is opened to cut supply of current to the solenoid of solenoid valve 138 causing solenoid valve 138 to close vacuum port 136 to connect chamber 122 to air bleed port 134. Thus under the condition, spring 120 biases plunger 116 to the illustrated position to cause valve member 112 to take the illustrated position in which effective flow area is a minimum.

The rate of recirculation of exhaust gases is thus reduced when the vehicle speed is above the predetermined value of 50 km/h.

If desired, a transmission gear switch may be used as switch 140 which is closed only when the transmission is shifted into a top gear position. In this case the rate of recirculation of exhaust gases is reduced when the transmission is shifted into the top gear position.

Figure 6:
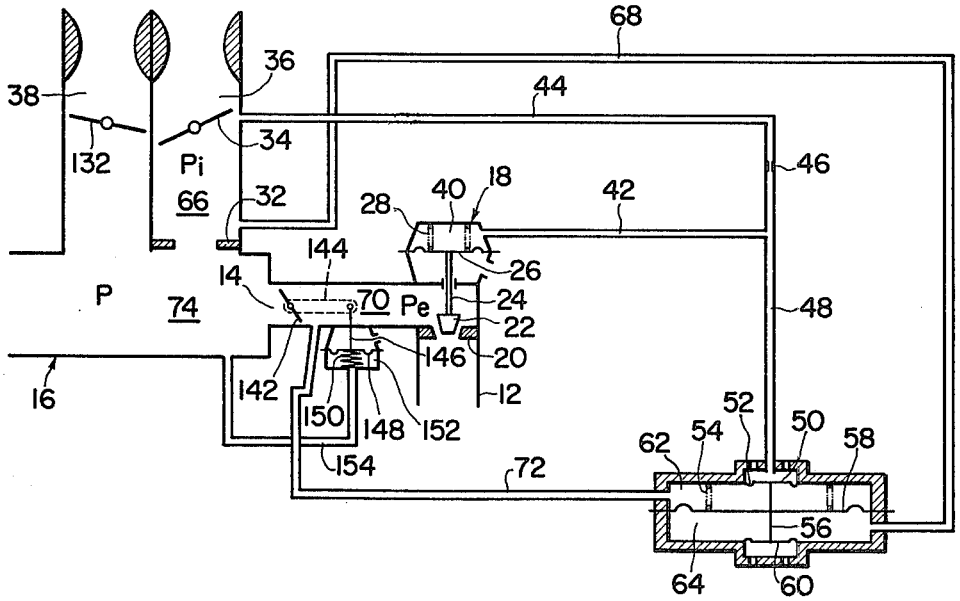

Referring to FIG. 6 embodiment, this differs from FIG. 1 embodiment only in that instead of orifice plate 30 shown in FIG. 1 a valve member 142 is disposed in EGR passage 12 downstream of valve seat 20 with which EGR valve member 22 cooperates. Valve member 142 is operatively connected through a suitable linkage 144, only shown in diagram, to a plunger 146 which is fixedly carried by a pressure responsive diaphragm 148 and biased upwardly by a spring 150. A chamber 152 below pressure responsive diaphragm 148 communicates through a pipe 154 with zone 74 of air induction passage 16 to allow induction pressure P in zone 74 to be transmitted to chamber 152.

In the illustrated position of valve member 142 the effective flow area through valve member 142 is a maximum. When induction pressure P transmitted to chamber 152 below pressure responsive diaphragm 148 decreases below a predetermined value, such as −400 mmHg, plunger 146 is moved downwardly against the bias of spring 150 and this movement of plunger 146 causes valve member 142 to rotate clockwise to reduce the effective flow area therethrough.

A decrease in the effective flow area through valve member 142 decrease the effect of induction pressure P on pressure Pe in zone 70 and thus pressure Pe increases. Upon this increase in pressure Pe, air bleed valve member 50 is biased downwardly to increase air bleed through air bleed pipe 48 to chamber 40. As a result EGR valve member 22 is moved toward valve seat 20 and the rate of recirculation of exhaust gases is decreased as the effective flow area through valve member 142 is reduced.

Thus the rate of recirculation of exhaust gases is decreased when the induction vacuum decreases below the predetermined level.

What is claimed is:

1. An exhaust gas recirculation system in an internal combustion engine comprising an induction passage with a throttle valve therein for controlling air flow therethrough to the engine;

an exhaust passage;

an exhaust gas recirculation passage having a first portion leading from said exhaust passage and a second portion extending to said induction passage downstream of said throttle valve;

an exhaust gas recirculation flow control valve including a valve seat arranged in said exhaust gas recirculation passage to permit the flow of exhaust gases from the first portion of said exhaust gas recirculation passage toward the second portion of said recirculation passage, a valve member cooperable with said valve seat to control the flow of exhaust gases therethrough;

a first flow restrictor located in the second portion of said exhaust gas recirculation passage to define a first zone between said first flow restrictor and said valve seat;

a second flow restrictor located in said induction passage downstream of said throttle valve and upstream of a discharge port opening to said air induction passage to which said exhaust gas recirculation passage leads so as to define a second zone between said second flow restrictor and said throttle valve; and control mechanism operable to maintain a difference between a first pressure in said second zone and a second pressure in said first zone at a predetermined magnitude, including a first spring biasing said valve member into engagement with said valve seat, a pressure responsive member connected to said valve member, a chamber in communication by way of a first and a second opening with induction vacuum downstream of said throttle valve and with atmosphere respectively, so as to develop in said chamber a control pressure which is applied to said pressure responsive member, a bleed valve associated with one of said openings so as to control flow therethrough and regulate said control pressure, a pressure responsive device connected to said bleed valve and operable in response to increased difference between said first and second pressure to displace said bleed valve and decrease said control pressure and enable said pressure responsive member to overcome the bias of said first spring and displace said valve member to increase recirculation of exhaust gases, and a second spring arranged so as to bias said bleed valve to increase said control pressure upon a decrease in difference between said first and second pressure and enable said first spring to displace said valve member towards said valve seat and decrease the recirculation of exhaust gases.

2. The system as claimed in claim 1, in which said induction passage includes a primary air induction barrel with said throttle valve and said second flow restrictor therein and a secondary air induction barrel with a second throttle valve therein.

3. The system as claimed in claim 1, in which said bleed valve operable to control the flow of air through said second opening and in which said pressure responsive device includes a second chamber in communication with said first zone, a third chamber in communication with said second zone, and a second pressure responsive member operatively connected to said bleed valve and operable in response to difference between pressures in said second and third chambers, respectively.

4. The system as claimed in claim 1 further comprising a second bleed valve associated with said third opening, by way of which said second chamber is in communication with atmosphere, so as to control flow therethrough and regulate said second pressure; a third spring arranged to displace said second bleed valve to cause said second bleed valve to close said third opening; and a second pressure responsive device connected to said second bleed valve and operable in response to a decreased pressure in said control pressure above a predetermined level to displace said second bleed valve against the bias of said third spring and increase said first pressure and enable said first pressure responsive device to cause said pressure responsive member connected to said valve member of said control mechanism to reduce recirculation of exhaust gases.

5. The system as claimed in claim 4, further comprising means including a second chamber in communication with induction pressure in said air induction passage so as to bias said pressure responsive member in such a manner as to assist the biasing action of said first spring.

6. The system as claimed in claim 2, in which the effective flow area of at least one of the first and second flow restrictors is variable in response to operating conditions of the engine.

7. The system as claimed in claim 6, in which the effective flow area of said second flow restrictor is controllably varied by a valve which is disposed in said primary air induction barrel downstream of said first throttle valve and which increases the effective flow area therethrough in response to increased opening degree of said first throttle valve.

8. The system as claimed in claim 6, in which the effective flow area of said second flow restrictor is controllably varied by a valve which is disposed in said primary air primary air induction barrel downstream of said throttle valve and which increases the effective flow area therethrough in response to a decrease in an induction pressure in said air induction passage.

9. The system as claimed in claim 6, in which the effective flow area of said second flow restrictor is controllably varied by a valve which is disposed in said primary air induction barrel downstream of said first throttle valve and which increases the effective flow area therethrough in response to a decrease in a pressure in one of a venturi in said primary air induction barrel and a location in said secondary air induction barrel on the atmosphere side of said second throttle valve.

10. The system as claimed in claim 6, in which the effective flow area of said second flow restrictor is controllably varied by a valve which is disposed in said primary air induction barrel downstream of said first throttle valve and which varies the effective flow area therethrough in response to a predetermined condition of one of vehicle speed and the associated transmission.

11. The system as claimed in claim 6, in which the effective flow area of said first flow restrictor is controllably varied by a valve which is disposed within said exhaust gas recirculation passage downstream of said valve seat and which reduces the effective flow area therethrough in response to a decrease in an induction pressure in said air induction passage.

* * * * *